US005950885A

United States Patent [19]

Morgan

[11] Patent Number: 5,950,885

[45] Date of Patent: Sep. 14, 1999

[54] GARMENT HANGER WITH REINFORCED NON-CREEP CLAMP RETAINERS

[75] Inventor: Donald F. Morgan, Zeeland, Mich.

[73] Assignee: Batts, Inc., Zeeland, Mich.

[21] Appl. No.: 08/918,079

[22] Filed: Aug. 25, 1997

[51] Int. Cl.[6] ..... A47G 25/48

[52] U.S. Cl. ..... 223/96; 24/536

[58] Field of Search ..... 223/96, 93, 91, 223/90, 85; 24/536, 537

[56] References Cited

U.S. PATENT DOCUMENTS

| | | | |
|---|---|---|---|
| 2,546,717 | 3/1951 | Beetlestone et al. | 223/96 |
| 3,767,092 | 10/1973 | Garrison et al. | 24/536 |
| 4,157,782 | 6/1979 | Mainetti | 223/96 |
| 4,718,581 | 1/1988 | Chiaramonte | 223/96 |
| 5,267,678 | 12/1993 | Zuckerman | 223/96 |
| 5,297,706 | 3/1994 | Blitz | 223/96 |
| 5,539,963 | 7/1996 | Fujiwara et al. | 24/536 |

*Primary Examiner*—Bibhu Mohanty
*Attorney, Agent, or Firm*—Baker & McKenzie

[57] ABSTRACT

A plastic clamp assembly, and a garment hanger containing said plastic clamp assembly, in which plastic creep of the plastic clamp assembly, and thereby loss of load, is eliminated by use of a metal reinforcement, which is not subject to creep, for the clamp assembly.

14 Claims, 2 Drawing Sheets

GARMENT HANGER WITH REINFORCED NON-CREEP CLAMP RETAINERS

This invention relates generally to garment hangers and specifically to a garment hanger of the type having one or more clamp structures from which a garment is hung in which creep of the material from which the clamp structure is made, usually plastic, is eliminated.

BACKGROUND OF THE INVENTION

Garment hangers of the type having a clamp structure at each end of a generally horizontally oriented support bar are well known. The clamp structures of such hangers may be formed separately from the support bar or integrally with the support bar, and variations of both types have been successfully used. Recently there appears to be a trend to utilize the integrally formed type since, among other reasons, the main portion of the hanger and the clamp structure can be formed in a single forming operation, usually molding, with concomitant cost advantages. Although the invention is adaptable to garment hangers in which the clamp structure is both integrally and separately formed, this invention will be described in conjunction with the type of hanger in which the clamp structure is integrally formed with the balance of the hanger since the deficiency which this invention overcomes appears to be most pronounced in this type of hanger.

Usually the clamp structure or structures of the hanger consist of a pair of clamp jaws which are relatively movable away from one another to provide an open maw capable of receiving an article of clothing to be suspended, initially for display and thereafter for storage, and toward one another to frictionally grip and retain the garment to the hanger for suspension. Although plastic, with its well known characteristic of tending to return to its formed shape, makes possible the generation of forces which resist the opening of the jaws, and thus the application of frictional gripping forces to the garment to be suspended, as a practical matter the jaws must be so thick or hefty that it is inconvenient to open the jaws by the human hand preparatory to inserting a garment to be gripped therein. Even with the use of substantial material in the formation of the jaws, there is still the problem, in use, of unintended opening of one of the jaws due to unusually rough handling. And when the jaw clamps are formed with a living hinge at their bases, there is of course no resistance to jaw separation; indeed, in such structures the jaws are molded in an open condition to which they tend to return in the absence of closing forces applied thereto.

As a consequence, garment hangers of the foregoing description are nearly invariably supplied with a jaw clamp retainer assembly, the purpose of which is to ensure that the jaws exert and maintain a frictional gripping force on a garment with respect to which the two halves of the jaw clamp have been placed in contact.

Such clamp retainers have taken a myriad of forms, many of which are well known in the art. One form is a generally inverted U-shaped retainer which fits over the outside of the jaw clamps after the jaw clamps have had a garment inserted therein. The U-shaped retainer is preferably formed so that, although it slips easily over the garment gripping jaw clamp, it must be forced open against the resistance of the material from which it is composed in order to release the retaining pressure it exerts on the jaw clamp. Such inverted U-shaped clamp retainers may be separately formed with respect to the balance of the garment hanger, or integrally formed with the hanger, and this invention is applicable to both types.

There is, however, a deficiency in the inverted U-shaped type clamp retainers which is common to both the separately formed and integrally formed types, and that is the dimensional change which occurs in the clamp retainer over time, no matter how well made and proportioned such structure may be initially. Specifically, and speaking primarily in regard to the plastics which are today the plastics of choice in the garment hanger industry, the clamp retainers nearly invariably loosen due to plastic creep which, it is believed, is an attribute common to all of said hangers. The phenomena of creep (which differs from the above mentioned plastic memory characteristic) is a vexing one in that if the hanger designer anticipates the phenomena and designs sufficiently small clearances to ensure that a frictional gripping force is maintained on the jaw clamp with the passage of time, the clearance will usually be so small that it is difficult and tiring to the human operator to work with, and therefore impractical. On the other hand, if the hanger designer ignores the creep phenomena, it is a near certainty that the clamp retainer, and therefore the clamp structure, will go oversize after a period of time with resultant dissatisfaction on the part of the retail merchant who displays garments for sale, and the consumer who expects that his clothes hung on the hanger which he acquired with the purchase of the garment will remain on the garment hanger as it hangs in his closet. An example of the above described deficiency is disclosed in U.S. Pat. No. 5,297,706. To date, no satisfactory solution to the creep problem, particularly in hangers of the type in which the clamp retainer is integrally associated with the clamp structure, has been found.

SUMMARY OF THE INVENTION

The invention is a garment hanger, usually if not invariably, of the plastic type, having a clamp retainer reinforcement which cooperates with one or more clamp retainers to exert a permanent frictional or other gripping force on the clamp structure so that plastic creep is nullified. In a currently preferred form a clamp retainer reinforcement structure, which is not subject to plastic creep, cooperates with the clamp retainer to exert an independent, non-diminishing biasing force against the clamp retainer, and hence against the jaws of the clamp structure, so that plastic creep, even though it may occur in some or all of the plastic components of the clamp jaws and the clamp retainer, is positively compensated for and thereby nullified. In other words, the clamp presumably, though composed almost entirely of plastics is dimensionally stable in use. Further, the clamp retainer reinforcement is simple in construction and easy to apply to the clamp retainer, particularly on a production line, and hence the clamp retainer reinforcement adds very little, if any, to the cost of producing the garment hanger. It should also be noted that the entire clamp assembly consisting of clamp jaws, a clamp retainer for the clamp jaws, and a clamp retainer reinforcement are utilizable as a sub-combination in other environments as well as in combination with a garment hanger.

BRIEF DESCRIPTION OF THE DRAWING

The invention is illustrated more or less diagrammatically in the accompanying drawing in which.

DETAILED DESCRIPTION OF THE INVENTION

Figures 1, 2, 3, 4:
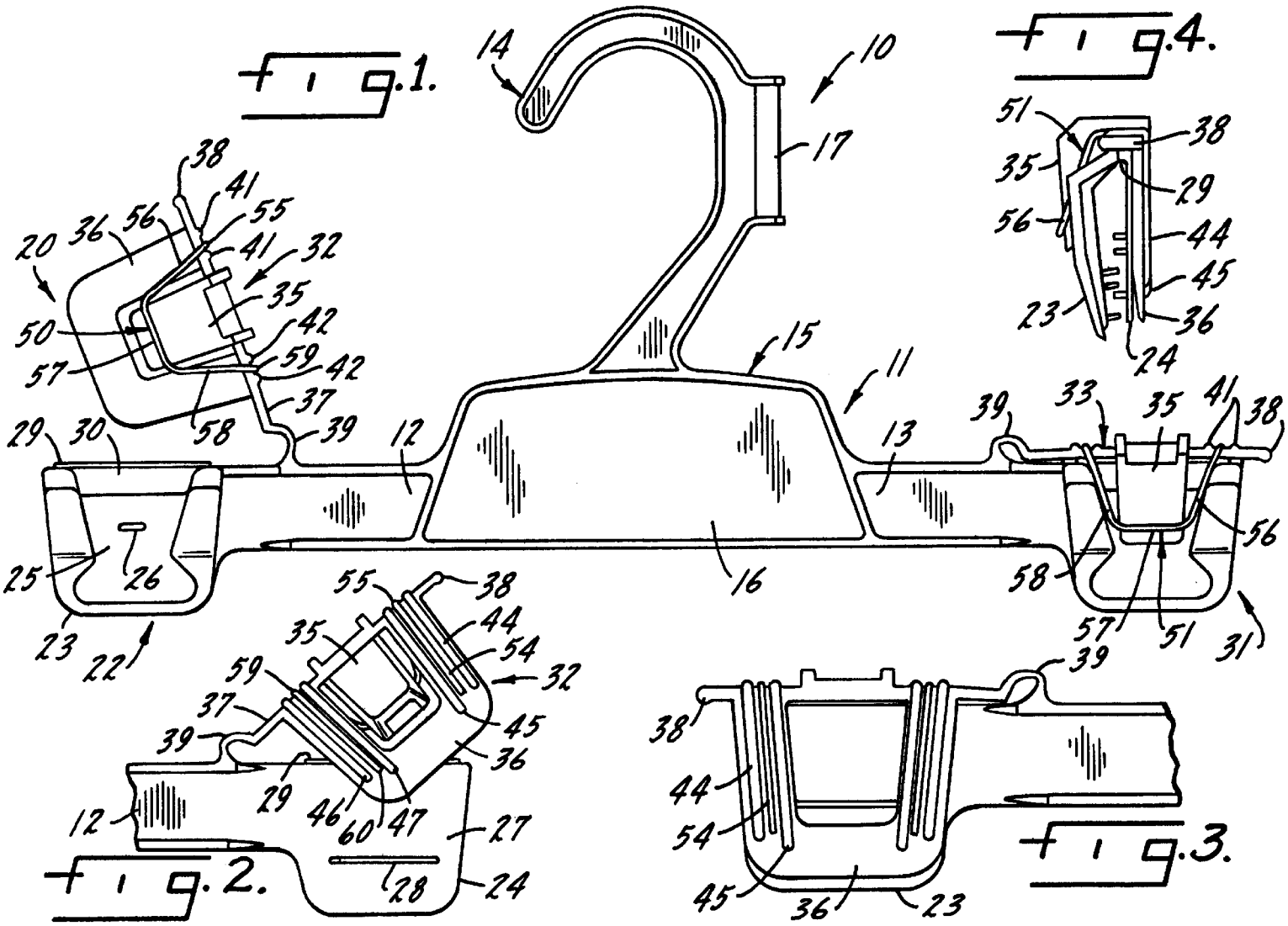
FIG. 1 is a side view of a garment hanger showing a clamp assembly of this invention at each end of the support bar of the garment hanger with one assembly in the disassembled position and the other clamp assembly assembled to the support bar of the hanger assembly.
FIG. 2 is a rear side view of the clamp assembly at the left end portion of FIG. 1.
FIG. 3 is a rear side view of the clamp assembly at the right end portion of FIG. 1.
FIG. 4 is a right end view of FIG. 1.

In describing the invention, like or similar reference numerals will be used to refer to like or similar parts from Figure to Figure in the drawing.

Referring first to FIG. 1, a garment hanger incorporating the invention is indicated generally at 10 in FIG. 1. The hanger includes a generally horizontally oriented base structure, here a support bar, indicated generally at 11, having left and right sides 12 and 13 respectively, and a hook, indicated generally at 14, for suspending the hanger from an elevated support location. Hook 14 extends upwardly directly from the support bar 11 or, as shown in FIG. 1, from a label section, indicated generally at 15, which in effect separates left and right sides 12 and 13 and has an expanded surface 16 of a size sufficient to receive a label or other marking or advertising indicia. A sizer is indicated at 17 on hook 14, but it will be understood that the sizer may be omitted or take any other desired form, such as a ring around the hook at its junction with the support bar 11.

A left clamp assembly is indicated generally at 20 at the left end portion of left side 12 of the support bar 11. The clamp assembly includes a jaw clamp indicated generally at 22 which includes front clamp jaw 23, see FIG. 1, and rear clamp jaw 24, see FIG. 2. The outside surface 25 of front clamp jaw 23 includes a short locking ridge 26 which is positioned to engage a mating projection on the clamp retainer assembly to be described hereinafter. The outside surface 27 of rear clamp jaw 24 also includes a locking ridge 28 which is adapted to engage a mating projection on the clamp retainer. It will be understood, as will become more readily apparent in connection with reference to FIG. 4, that the lower portions of each of front and rear clamp jaws 23 and 24 carry projections or other structure intended to make contact with a garment held between the jaws and preclude said garment from dropping downward. A base 29 forms the connection between the front and rear clamp jaws 23 and 24. In this connection, it will be understood that the base 29 and one, or both, of the front and rear clamp jaws may be formed as a living hinge so that the clamp jaws can swing open relative to one another about the base, or a base/hinge junction, as a pivot to form an open maw into which a garment to be suspended may be inserted.

An inclined surface at the upper end of the outside surface of the rear clamp wall is indicated at 30. The upper edge of the inclined surface terminates at the hinge/base junction and serves to cam the clamp retainer, next to be described, into closed and locking position. A right clamp assembly is indicated generally at 31, said right clamp assembly being a mirror image of left clamp assembly 20.

A clamp retainer assembly is indicated generally at 32 operatively associated with the left clamp assembly 20, and another clamp retainer assembly is indicated generally at 33 operatively associated with the right clamp assembly 31.

The clamp retainer assembly 32 has a generally U-shaped cross sectional configuration and includes a front wall 35, which in this instance, is formed as a solid plate, and a rear wall 36 which, in this instance, is formed in a U-shape with an open interior. The front and rear walls 35 and 36 extend downwardly from a base or bight section 37 which terminates at its outermost end, which extends outwardly past front wall 36, in a lifting knob 38. The base 37, and thereby retainer assembly 32, is connected to the top edge of left side 12 of the support bar 11 by a hinge 39 which permits easy flexing or rotation of the retainer assembly about the hinge which functions as a pivot. The upper surface of base 37 has an outer pair of top transverse ridges 41 and an inner pair of transverse ridges 42 for a purpose to be described. Said outer pair of top transverse ridges 41 continue downwardly at 44, 45, on the rear side of rear wall 36 with ridge or rib 45 extending downwardly slightly further than rib 44, all as best seen in FIG. 2. The outer pair of top transverse ridges 42 continue downwardly at 46, 47 on the rear side of rear wall 36 with ridge or rib 47 extending downwardly slightly further than rib 46, all as best seen in FIG. 2.

A left clamp retainer reinforcement is indicated generally at 50 and a right clamp retainer reinforcement at 51 in FIG. 1. Since the reinforcements are identical it is only necessary to describe one in detail, though reference will be made, by necessity, to both reinforcements 50 and 51.

The reinforcement 50 is formed from a single length of elongated metal, here a wire whose left rear end, as viewed in FIG. 1, is indicated at 54, see FIG. 2 where the directions are reversed, a left top bight 55, a left front section 56, front bight portion 57, right front section 58, right top bight 59, and right end 60. It will be noted that the left top bight 55 is received between the outer transverse ridges 41, and the right top bight portion 59 is received between the inner transverse ridges 42 so that the reinforcement is precluded from moving bodily longitudinally along the base/bight section 37. By the same token, the left end 54 is received between rear wall ribs 44 and 45, and right end 60 is received between rear wall ribs 46 and 47.

The front bight portion 57, which forms one leg of the generally U-shaped cross sectional configuration of the reinforcement 50, bears against the outer bottom end portion of front wall 35 in abutting, pressure contacting relationship. The reinforcement, which is not subject to plastic creep, is formed so that it must be sprung apart to fit over the left clamp retainer assembly 32 so that a constant, non-diminishing force is exerted on the left clamp retainer assembly which overrides and, in effect, supersedes the clamping force derived from front and rear sides 35, 36 of the clamp retainer assembly 32.

Figure 5:
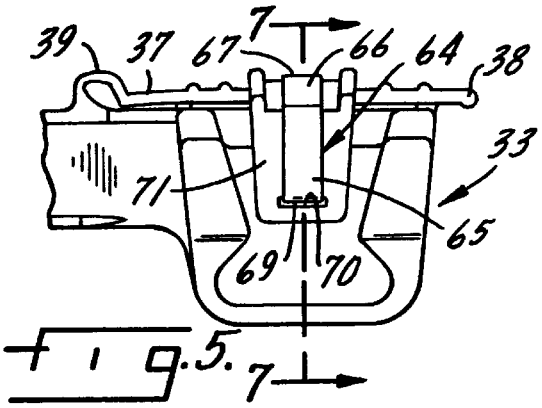
FIG. 5 is a view similar to the showing at the right end portion of FIG. 1 illustrating a first variant of the invention in an assembled condition.
Figure 6:
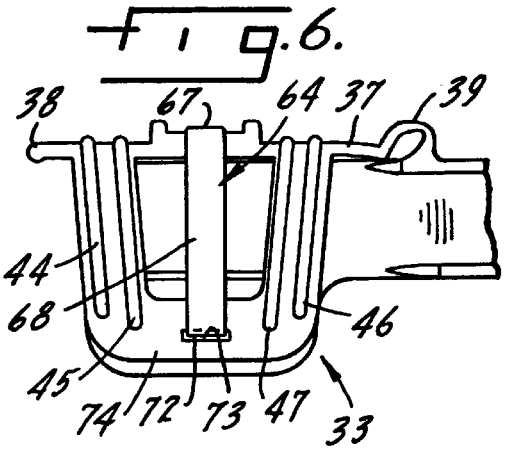
FIG. 6 is a view similar to FIG. 3 showing the rear side view of the first variant of the invention in an assembled condition.
Figure 7:
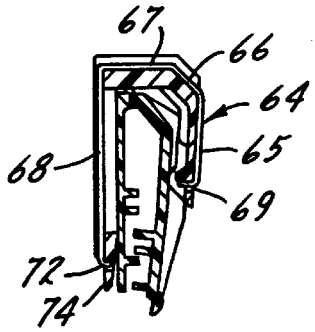
FIG. 7 is a view taken substantially along the line 7—7 of FIG. 5.

Referring now to the variant of FIGS. 5–7, it will be noted that the construction of the clamp retainer assembly 32 is virtually identical to the clamp retainer assembly of FIGS. 1–4, though it need not be. For example, outer and inner transverse ridges 41, 42 and ribs 44–47 could if desired be eliminated.

In this variant the bent wire reinforcement 50 has been replaced by inverted U-shaped strap, indicated generally at 64, which consists of front leg 65, which has an upper inclined portion 66, a bight portion 67 and a rear leg 68. As in the variant of FIGS. 1–4, the front and rear legs 65 and 68, and particularly the lower end portions thereof, bear against the outside surfaces of the jaw means in abutting, pressure applying contacting relationship. The lowermost tip of front leg 65 extends inwardly, as at 69. Said tip 69 fits into a mating aperture 70 in front wall 71 of the clamp retainer. By the same token, the lowermost tip of rear leg 68 extends inwardly, as at 72. Said tip 72 fits into a mating aperture 73 in rear wall 74. See FIG. 7 for further orientation of the strap 64, and particularly its front and rear legs 65 and 68, with respect to the clamp retainer 32.

Figure 8:
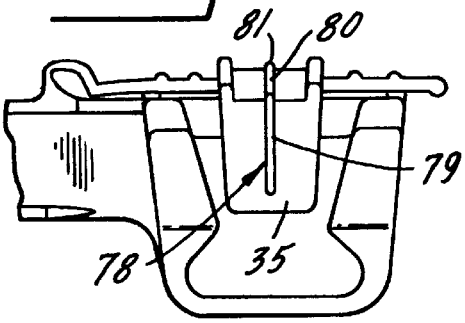
FIG. 8 is a view similar to the showing at the right end portion of FIG. 1 illustrating a second variant of the invention in an assembled condition.
Figure 9:
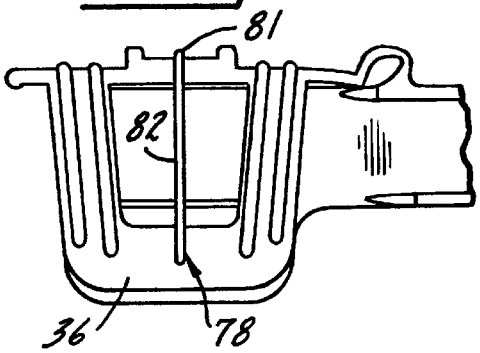
FIG. 9 is a view similar to FIG. 3 showing the rear side view of the second variant of the invention in an assembled condition.

Referring now to the variant of FIGS. 8 and 9, it will be noted that the construction of the clamp retainer assembly 32 is virtually identical to the clamp assembly of FIGS. 1–4, though it need not be. For example, outer and inner transverse ridges 41, 42 and ribs 44–47 could if desired be eliminated.

In this variant the multi-plane bent wire reinforcement 50 of FIGS. 1–4 has been replaced by a single strand of an inverted U-shaped wire, indicated generally at 78, whose portions lie in the same plane and which consists of front leg 79, which has an inclined portion 80, a bight portion 81, and a rear leg 82. The lowermost tip, not shown, of prong leg 79 extends inwardly into a mating recess, including a hole which extends completely through the front wall 71. By the same token the lowermost tip, not shown, of rear leg 82 extends inwardly into a mating aperture, not shown, in rear wall 36. The engagement of the tips into recesses in the jaw means results in an additional mechanical locking action between the length of elongated metal and the jaw means.

Common to all variants is the use of a non-creep metal reinforcement which exerts a continuous and non-diminishing force on the clamp retainers, and hence the clamp jaws, which eliminates jaw separation due to plastic creep.

Although a specific example, and several modifications thereof, have been illustrated and described, it will at once be apparent to those skilled in the art that modifications to the basic inventive concept may be made within the spirit and scope of the invention. Hence the scope of the invention should only be limited only by the scope of the hereafter appended claims when interpreted in light of the relevant prior art.

What is claimed is:

1. A dimensionally stable clamp assembly for hanging a garment, clamping force existing portions of said clamp assembly being composed almost entirely of plastic, said stable clamp assembly including, in combination clamping structure for exerting a clamping force on opposed jaws means within which a garment to be retained is received, said clamping structure having a generally U-shaped cross sectional configuration and consisting of a first downwardly depending side portion, a second downwardly depending side portion and a bight portion there between, said clamping structure being composed of plastic which is subject to creep, means for operatively associating said clamping structure with jaws means whereby the assemblage of said jaws means and said clamping structure exerts an initial gripping and holding force on a garment in contact with said jaw means whereby said garment, may, if desired, be suspended from said jaw means, and means for eliminating creep of the clamping structure whereby the initial gripping and holding force may be maintained continuously and in a non-diminishing condition, said creep eliminating means including a length of elongated metal, said length of elongated metal having a generally U-shaped cross sectional configuration, the end portions of which are in pressure contact with the first side portion and second side portion of the clamping structure, said end portions of the length of elongated metal being continuously spring biased toward one another when in contact with said first side portion and said second side portion of the clamping structure to thereby maintain, in a continuous and non-diminishing condition, the initial gripping and holding force of the jaw means on a garment received therein.

2. The dimensionally stable clamp assembly of claim 1 further characterize in that said jaw means are composed of plastic which is subject to creep.

3. The dimensionally stable clamp assembly of claim 1 further characterized in that said means for operatively associating said clamping means with said jaw means includes a base structure, said jaw means being formed integral with said base structure.

4. The dimensionally stable clamp assembly of claim 3 further characterized in that said clamping structure is formed integrally with said base structure and is bodily movable into and out of contact with said jaw means.

5. The dimensionally stable clamp assembly of claim 4 further characterized in that said base structure is composed of plastic and said clamping structure is connected to the base structure by a hinge which is integrally formed with both the base structure and the clamping structure.

6. The dimensionally stable clamp assembly of claim 1 further characterized in that the terminal end portions of the generally U-shaped cross sectional configuration length of elongated metal are in abutting, pressure applying contact with outside surfaces of said jaw means.

7. The dimensionally stable clamp assembly of claim 6 further characterized in that the tips of the elongated length of metal are received in apertures in the jaw means to thereby provide an additional mechanical locking action of the length of elongated metal to the jaw means.

8. In a garment hanger, a support bar, hang means located at the mid-portion of the support bar to suspend the garment hanger, together with a garment carried thereby, from an elevated support location, and a dimensionally stable clamp assembly carried by the support bar for gripping and holding a garment to be hung from the hanger, said clamp assembly being composed almost entirely of plastic, said dimensionally stable clamp assembly further including, in combination, clamping structure for exerting a clamping force on opposed jaws means within which a garment to be retained is received, said clamping structure having a generally U-shaped cross sectional configuration and consisting of a first downwardly depending side portion, a second downwardly depending side portion and a bight portion there between, said clamping structure being composed of plastic which is subject to creep, means for operatively associating said clamping structure with said jaws means whereby the assemblage of said jaws means and said clamping structure exerts an initial gripping and holding force on a garment in contact with said jaw means whereby said garment, may, if desired, be suspended from said jaw means, and means for eliminating creep of the clamping structure whereby the initial gripping and holding force may be maintained continuously and in a non-diminishing condition, said creep eliminating means including a length of elongated metal, said length of elongated metal having a generally U-shaped cross sectional configuration, the end portions of which are in pressure contact with the first side portion and second side portion of the clamping structure, said end portions of the length of elongated metal being continuously spring biased toward one another when in contact with said first side portion and said second side portion of the clamping structure to thereby maintain, in a continuous and non-diminishing condition, the initial gripping and holding force of the jaw means on a garment received therein.

9. The garment hanger of claim 8 further characterized in that said jaw means are composed of plastic which is subject to creep.

10. The garment hanger of claim 8 further characterized in that said means for operatively associating said clamping means with said jaw means includes a base structure, said jaw means being formed integral with said base structure.

11. The garment hanger of claim 10 further characterized in that said clamping structure is formed integrally with said base structure and is bodily movable into and out of contact with said jaw means.

12. The garment hanger of claim 11 further characterized in that said base structure is composed of plastic and said clamping structure is connected to the base structure by a hinge which is integrally formed with both the base structure and the clamping structure.

13. The garment hanger of claim 8 further characterized in that the terminal end portions of the generally U-shaped cross sectional configuration length of elongated metal are in abutting, pressure applying contact with outside surfaces of said jaw means.

14. The garment hanger of claim 13 further characterized in that the tips of the elongated length of metal are received in apertures in the jaw means to thereby provide an additional mechanical locking action of the length of elongated metal to the jaw means.

* * * * *